US006708147B2

(12) United States Patent
Mekuria et al.

(10) Patent No.: US 6,708,147 B2
(45) Date of Patent: Mar. 16, 2004

(54) METHOD AND APPARATUS FOR PROVIDING COMFORT NOISE IN COMMUNICATION SYSTEM WITH DISCONTINUOUS TRANSMISSION

(75) Inventors: Fisseha Mekuria, Lund (SE); Joakim Persson, Lund (SE)

(73) Assignee: Telefonaktiebolaget LM Ericsson(Publ), Stockholm (SE)

( * ) Notice: Subject to any disclaimer, the term of this patent is extended or adjusted under 35 U.S.C. 154(b) by 410 days.

(21) Appl. No.: 09/796,380

(22) Filed: Feb. 28, 2001

(65) Prior Publication Data

US 2002/0120439 A1 Aug. 29, 2002

(51) Int. Cl.[7] ..... G10L 11/00
(52) U.S. Cl. ..... 704/228
(58) Field of Search ..... 704/228, 226, 704/227

(56) References Cited

U.S. PATENT DOCUMENTS

| | | | | | |
|---|---|---|---|---|---|
| 5,511,072 | A | * | 4/1996 | Delprat | 370/336 |
| 5,630,016 | A | | 5/1997 | Swaminathan et al. | 395/2.37 |
| 5,657,422 | A | | 8/1997 | Janiszewski et al. | 395/2.37 |
| 5,706,394 | A | * | 1/1998 | Wynn | 704/219 |
| 5,722,086 | A | | 2/1998 | Teitler et al. | 455/561 |
| 5,802,109 | A | | 9/1998 | Sano | 375/245 |
| 5,870,397 | A | | 2/1999 | Chauffour et al. | 370/435 |
| 5,883,893 | A | | 3/1999 | Rumer et al. | 370/395 |
| 5,953,666 | A | * | 9/1999 | Lehtimaki | 455/439 |
| 5,953,698 | A | * | 9/1999 | Hayata | 704/230 |
| 5,960,389 | A | * | 9/1999 | Jarvinen et al. | 704/220 |
| 5,970,441 | A | | 10/1999 | Mekuria | 704/207 |
| 5,978,756 | A | | 11/1999 | Walker et al. | 704/210 |
| 5,991,716 | A | * | 11/1999 | Lehtimaki | 704/212 |
| 6,023,674 | A | | 2/2000 | Mekuria | 704/233 |
| 6,041,230 | A | * | 3/2000 | Siira | 455/422.1 |
| 6,081,732 | A | * | 6/2000 | Suvanen et al. | 455/570 |
| 6,138,020 | A | * | 10/2000 | Galyas et al. | 455/436 |
| 6,198,458 | B1 | | 3/2001 | Heinz et al. | 343/853 |
| 6,347,081 | B1 | * | 2/2002 | Bruhn | 370/337 |

FOREIGN PATENT DOCUMENTS

| | | |
|---|---|---|
| EP | 0756267 | 1/1997 |
| JP | 4258037 | 9/1992 |
| JP | 5049054 | 2/1993 |

OTHER PUBLICATIONS

Southcott, et al., "Voice Control of the Pan–European Digital Mobile Radio System", Nov. 27, 1989, 1070–1074.

EPO Standard Search Report, RS 106653 US, dated Sep. 4, 2001.

* cited by examiner

*Primary Examiner*—Susan McFadden
(74) *Attorney, Agent, or Firm*—Jenkens & Gilchrist, P.C.

(57) ABSTRACT

In a voice communication system having a transmitter and receiver on opposing sides of an interface, the transmitter is switched on to transmit speech components and is switched off during speech pauses. To provide comfort noise at the receiver, and thus avoid annoying effects caused by continual switching of the transmitter, a comfort noise generator disposed to produce comfort noise of an adjustable amplitude is located on the receiver side of the interface. A first subsystem responsive to operation of the transmitter provides a flag to the receiver to commence operation of the comfort noise generator, when the transmitter discontinues transmission in response to a speech pause. A second subsystem transmits a succession of amplitude parameters through the interface to selectively adjust the amplitude of the generator in corresponding relationship with a noise level at the transmitter.

19 Claims, 2 Drawing Sheets

METHOD AND APPARATUS FOR PROVIDING COMFORT NOISE IN COMMUNICATION SYSTEM WITH DISCONTINUOUS TRANSMISSION

BACKGROUND OF THE INVENTION

The invention disclosed and claimed herein generally pertains to a method and apparatus for producing comfort noise in a system for transmitting information, wherein transmissions are intermittently discontinued. More particularly, the invention pertains to a system for transmitting human speech, wherein transmissions are discontinued during speech pauses. Even more particularly, the invention pertains to a communication system which is disposed to transmit information through an air interface.

There is increasing interest in providing mobile phones and other small electronic devices with the capability to connect and communicate wirelessly, over short ranges, with one another. Such capability would eliminate or substantially reduce the need for cables between devices such as phones, PC cards, headsets and laptops computers. Moreover, a number of such devices could thereby be joined together, very readily, to form small networks. As an example of this interest, the assignee herein, a major supplier of mobile telecommunication equipment and systems, has initiated a program known as the Bluetooth air interface to develop wireless communication capability of the above type.

In interconnecting small devices over a short range air interface, it is very important to restrain costs, and also to reduce the overall interference level on the interface, in order to improve RF spectrum efficiency. Accordingly, in an air interface such as the Bluetooth interface, a transmitter disposed to receive speech is provided with a discontinuous transmission (DTX) capability, which causes the transmitter to be switched off during speech pauses. Such capability reduces costs, by minimizing transmitter power requirements and also reduces signal interference level. The benefits of DTX may be particularly significant in connection with telephone transmissions, in view of the fact that during a normal phone conversation, the participants alternate so that, on average, each direction of transmission is utilized only about 50% of the time.

Notwithstanding the benefits and advantages of discontinuous transmission, background noise, which is transmitted together with speech in a system of the above type, disappears during silent or speech absent periods when the transmitter is switched off. This results in modulation of the background noise. More particularly, since switching of the transmitter between its transmit and transmit discontinue modes can be quite rapid, a very annoying noise effect can be produced at the receiver.

A principal technique of the prior art, to avoid such annoying noise, has been to model the background noise by speech encoder model parameters which are updated at low rate intervals. The model parameters are then used to generate comfort noise signal on the receiver side of the communication system, during periods when the transmitter is turned off. Such a scheme is generally suitable when both a model-based speech coder and a high performance DSP (Data Processor?) are available, in order to generate the required comfort noise at the receiver side. However, in short range air interface systems of the type described above, such as Bluetooth, these assumptions are not applicable. Neither the model parameters for the background noise, nor a DSP of sufficient computational capability, are typically available. Moreover, the voice coder in Bluetooth is a waveform coder with a one-bit quantization scheme, called the continuously variable slope delta modulation (CVSD). The 64 kb/s CVSD is a non-linear waveform coder with no model information available, apart from instantaneous waveform amplitude and slope information. These parameters are not amenable for modeling background noise, due to their rapidly varying nature.

SUMMARY OF THE INVENTION

In the invention, it has been recognized that background noise perception is based primarily on power level or amplitude of the noise information. This is true because the amplitude modulation (between silence and noise-containing speech components) of the background noise is the principal cause of the annoying noise which occurs during DTX switching of the transmitter. Accordingly, comfort noise generated at the receiver, at an amplitude which is substantially equal to the transmitter side amplitude, enhances speech quality and significantly diminishes the annoying effects described above. In accordance with the invention disclosed herein, adequate comfort noise may be provided, simply by judicious adjustment of a comfort noise generator located at the receiver side of the transmission interface. Thus, the invention provides a comparatively simply technique based on auditory perception of background noise, relative to the speech signal.

In one embodiment, the invention is generally directed to apparatus for providing comfort noise in a communication system used in connection with an audio voice signal comprising interspersed speech present periods and silent periods, wherein the communication system comprises a transmitter and receiver at opposing sides of a transmission path or interface, and the transmitter is provided with the aforesaid DTX capability. Thus, the transmitter is disposed to transmit the audio signal to the receiver during speech present periods, and to discontinue transmissions during silent periods. The apparatus comprises a comfort noise generator at the receiver side of the interface for producing comfort noise of adjustable amplitude. The apparatus further comprises a first subsystem for detecting silent periods at the transmitter side, and for providing notice to the receiver when the transmitter discontinues transmission of the audio signal. A second subsystem is provided for transmitting a succession of amplitude parameters through the interface to selectively adjust the amplitude of the generator, in corresponding relationship with a noise level detected at the transmitter.

In a preferred embodiment of the invention, the first subsystem includes a voice activity detector incorporated into the transmitter for producing speech present and speech absent flags in response to speech present and silent periods, respectively, occurring in the audio signal. In a useful embodiment, the speech present and speech absent flags respectively comprise first and second digital bits, which are transmitted across the interface to the receiver. In an alternative embodiment, wherein voice information is transmitted across the interface in digital packets, the occurrence of a particular silent period which causes transmission to discontinue, is indicated to the receiver by preventing transmission of a voice information packet which corresponds to the particular silent period.

Usefully, the second subsystem comprises a device for providing periodic estimates of the noise level at the transmitter, and further comprises means for transmitting amplitude adjustment parameters, which respectively represent the noise level estimates, across the interface to the comfort noise generator.

DETAILED DESCRIPTION OF THE PREFERRED EMBODIMENT

Figure 1:
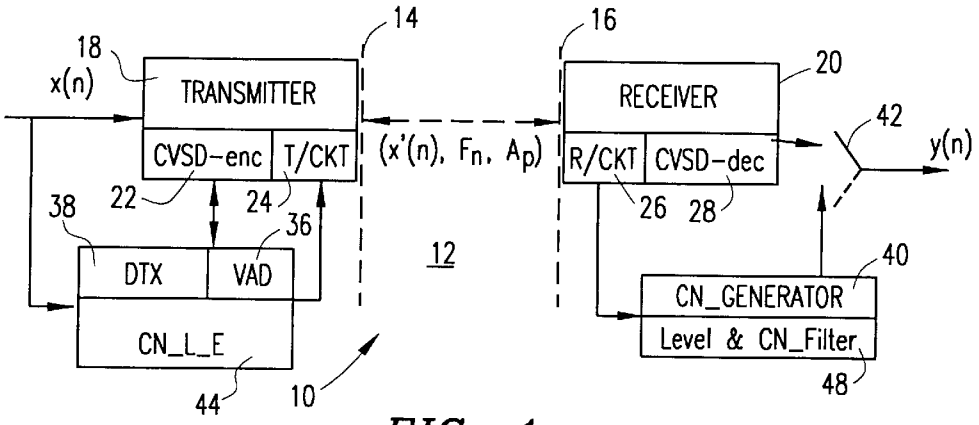
FIG. 1 is a block diagram showing a communication system which is provided with an embodiment of the invention.

Referring to FIG. 1, there is shown a communication system 10 for transmitting a voice signal x(n) through or across an air interface 12, from the transmitter side 14 of the interface to the receiver side 16 thereof. Communication system 10 comprises a transmitter 18 and components associated therewith, located on transmitter side 14, and further comprises a receiver 20 and components associated therewith, located on receiver side 16. The audio signal x(n) contains voice or speech components. Accordingly, FIG. 1 further shows transmitter 18 provided with a Continuously Variable Slope Delta modulation encoder 22 (CVSD-enc), usefully operable at 64 kb/s, which implements a voice encoder algorithm to encode the speech component of the incoming signal. The encoded signal x'(n) is transmitted across air interface 12 by a transmission circuit 24 or the like of transmitter 18, and received by a reception circuit 26 of receiver 20. The received signal is then decoded, by CVSD decoder (CVSD-dec) 28. While communication system 10 usefully comprises the Bluetooth system referred to above, the invention is by no means limited thereto.

Figure 2:
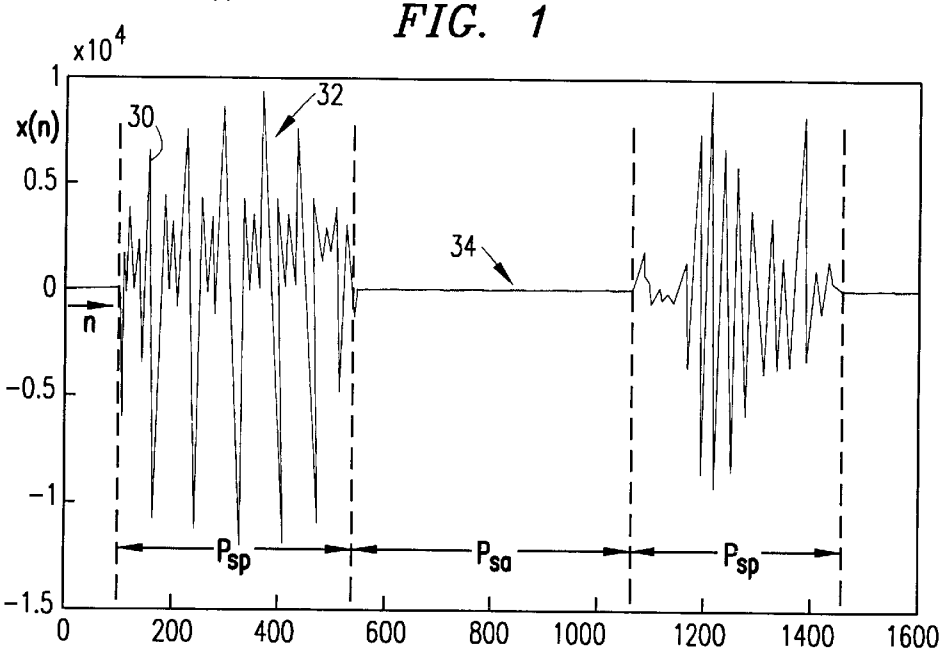
FIG. 2 is a waveform diagram showing an audio signal containing speech parts and silent parts as indicated by $P_{sp}$ and $P_{sa}$ respectively.

Referring to FIG. 2, there is shown audio signal x(n) comprising successive signal samples 30, the nth sample being of magnitude x(n). FIG. 2 further shows signal x(n) comprising periods $P_{sp}$ which contain speech components 32, interspersed between speech absent or silent periods $P_{sa}$, which contain only background noise components 34. It will be appreciated that x(n) represents a signal typically generated by a phone conversation or the like, that is, periods of speaking separated by speech pauses while listening to the other party.

As stated above, it is very advantageous, both to prolong transceiver battery life and to reduce interference over the air interface, to transmit signal x(n) only during speech present periods $P_{sp}$. Accordingly, transmission is discontinued during silent periods $P_{sa}$. To achieve such operation, FIG. 1 shows transmitter 18 further provided with a voice activity detector (VAD) 36 and a mechanism to discontinue transmission (DTX) 38. The VAD 36 senses the presence or absence of speech components 32 in the voice signal, and thus recognizes the occurrence of successive silent periods. Usefully, the voice activity detector 36 comprises a VAD invented by the inventors herein. However, it is not intended to limit the scope of the invention thereto. Such detector generates a notification flag comprising a digital 1 to indicate a speech component in the voice signal, and generates a digital 0 to indicate a period of silence therein. The digital flags are coupled to DTX mechanism 38, which operates to discontinue transmission of signal x(n) across interface 12 during silent periods $P_{sa}$, while enabling transmission during speech present periods $P_{sp}$.

In accordance with the invention, and to significantly diminish the annoying effects at the receiver described above, a comfort noise generator 40 is located on receiver side 16. When transmitter 18 is in a transmission mode, a switch 42, shown in FIG. 1, couples the output of CVSD decoder 28 to provide the receiver output y(n). However, during periods when transmission is discontinued, switch 42 couples a comfort noise signal produced by generator 40 to the receiver output. Thus, receiver output y(n) comprises speech components 32 of signal x(n), interspersed between periods of comfort noise from generator 40. To operate the switch 42, a flag $F_n$ is transmitted across interface 12, from transmitter 18 to receiver 20. The flag $F_n$ provides notice of the transmitter mode, whether transmission is occurring or discontinued, and is thus used to control operation of switch 42.

In one useful embodiment, flag $F_n$ is the notification flag produced by VAD 36 to operate DTX 38, as described above. In such embodiment $F_n$ would be a digital 1 to indicate transmission of a speech component, and would be a digital 0 to indicate a silent period in the voice signal and a corresponding discontinuation of transmission.

In a communication system such as Bluetooth, voice information is transmitted across an air interface in packets of digital bits, during assigned time slots. Accordingly, as an alternative technique for providing notice to the receiver of a silent period and consequent non-transmission, the flag $F_n$ would simply comprise the absence of a packet corresponding to the silent period, so that the packet would not be received during its anticipated time slot. This technique would eliminate the need to transmit one or more additional bits across the interface, and could be implemented by structuring the transmission circuit 24 to be responsive to the corresponding digital 0 flag generated by VAD 36.

As stated above, comfort noise provided by generator 40 must be at substantially the same amplitude as the background noise at the transmitter. Accordingly, FIG. 1 further shows a comfort noise level estimator (CN_l_E) 44 on transmitter side 14, which is connected to transmitter 18. The noise level estimator monitors noise level at the transmitter, and periodically computes a noise amplitude level parameter $A_p$. Successive values of amplitude $A_p$ are coupled across interface 12 to receiver 20 and generator 40, and the amplitude of comfort noise produced by generator 40 is successively adjusted to such values. In one useful embodiment, values of amplitude parameter $A_p$ are sent across the interface every 0.375 seconds, in digital form having a maximum size of two bytes.

Figure 3:
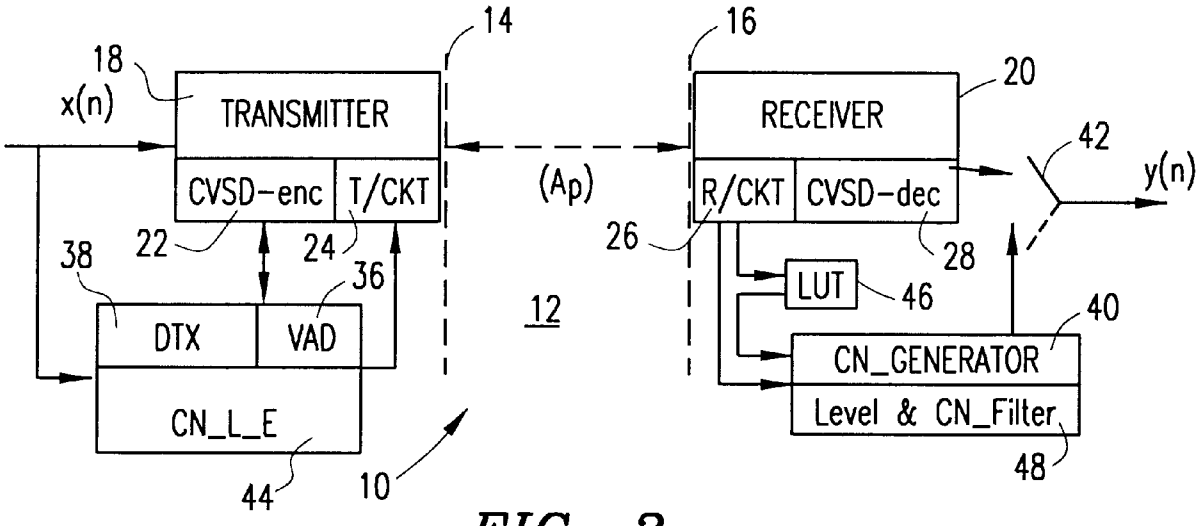
FIG. 3 is a block diagram showing components for a modification of the embodiment of FIG. 1.

Referring to FIG. 3, there is shown an alternative embodiment which limits the size of parameter $A_p$ transmitted across the interface to three bits. FIG. 3 shows communication system 10 as described above. In addition, however, FIG. 3 shows a look-up table 46 on receiver side 16 which is coupled to generator 40, and also to reception circuit 26. In one embodiment of the invention, it has been recognized that quite adequate comfort noise may be provided by generator 40 if the amplitude of comfort noise is set to one of eight discrete predetermined levels. Accordingly, each of these levels is stored in look-up table 46. A particular level is selected by noise amplitude parameter $A_p$, and the amplitude of comfort noise provided by generator 40 is adjusted thereto. It will be readily apparent that only a three-bit parameter is required to select one of eight amplitude levels.

From the information provided by amplitude parameters $A_p$, comfort noise generator 40 computes white noise with the right noise amplitude level. The generated white noise can be colored to conform to the band limited nature and frequency characteristics of the noise at the transmitter side. This is achieved by applying a comfort noise filter (CN_ Filter) 48, shown in FIG. 1, to the white noise. In a system such as Bluetooth, the extra information bits of the amplitude adjustment parameter $A_p$ can be transmitted to the receiver side by utilizing a combined data-voice (DV) packet. The amplitude adjustment parameter can be placed in a data field which is mapped on bits 32–150 near the MSB of the DV packet.

Figure 4:
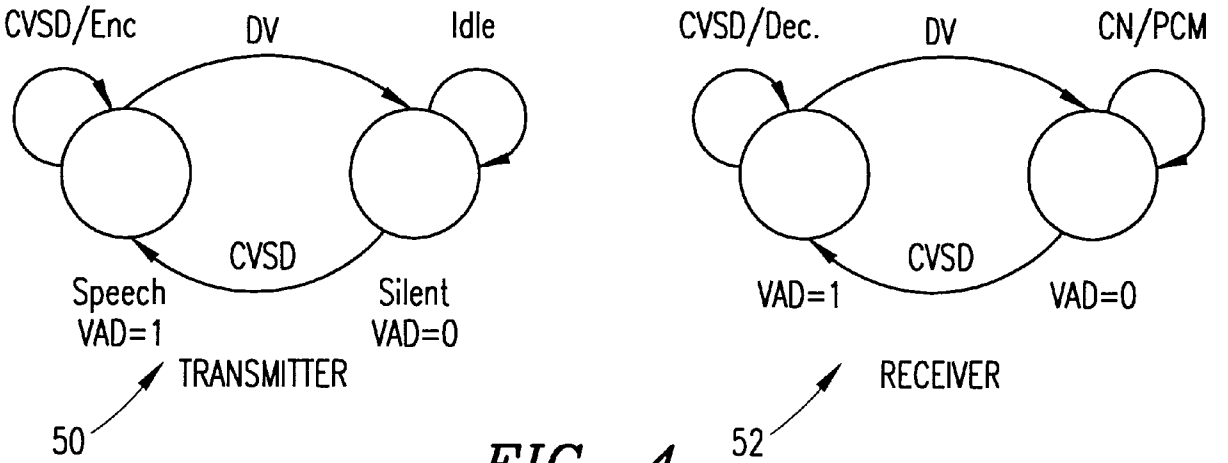
FIG. 4 is a state diagram depicting operation of the embodiment of FIG. 1.

Referring to FIG. 4, there is shown a state diagram describing the operation of an embodiment of the invention in such system, for the two states of switch 42 described above. More particularly, diagram 50 depicts the states at transmitter side 14 and diagram 52 depicts the states at receiver side 16. The transmitter 18 is switched off during VAD=0 and stays in the idle state, periodically sending DV or noise level information to the receiver side 16. During this time, the receiver side 16 generates comfort noise and sends it as a pulse code modulation (PCM) replacement to the background noise. During VAD=1, transmitter 18 is switched on, and the signal x(n) is CVSD encoded, transmitted across interface 12, and then decoded at receiver side 16.

Obviously, other modifications and variations of the present invention are possible in light of the above teachings. It is therefore to be understood that within the scope of the disclosed concept, the invention may be practiced otherwise than as specifically described.

What is claimed is:

1. In a communication system for use in connection with an audio signal comprising interspersed speech present periods and silent periods, wherein said system comprises a transmitter and receiver at opposing sides of a signal transmission interface, and wherein said transmitter is disposed to transmit said audio signal to said receiver during said speech present periods and to discontinue transmission thereof during said silent periods, apparatus for providing comfort noise comprising:

a comfort noise generator at said receiver side of said interface for producing comfort noise of adjustable amplitude;

a first subsystem responsive to said silent periods for notifying said receiver to activate said generator when said transmitter discontinues transmission of said voice signal; and a second subsystem for transmitting a succession of amplitude parameters through said interface to selectively adjust the amplitude of said comfort noise produced by said comfort noise generator in corresponding relationship with a noise level at said transmitter.

2. The apparatus of claim 1 wherein:

said first subsystem includes a voice activity detector incorporated into said transmitter for producing speech present and speech absent signals in response to said speech present periods and said silent periods, respectively, of said audio signal.

3. The apparatus of claim 2 wherein:

said speech present and speech absent signals comprise first and second digital bits, respectively, which are transmitted through said interface from said transmitter and received by said receiver, each of said first and second digital bits notifying said receiver of the transmission and non-transmission, respectively, of said audio signal; and said receiver is provided with switching means for coupling said comfort noise generator to the output of said receiver in response to a second digital bit, and for decoupling said generator from said output in response to a first digital bit.

4. The apparatus of claim 2, wherein voice information is transmitted through said interface in packets of digital bits, and wherein said first subsystem comprises:

means at said transmitter responsive to a given one of said silent periods for preventing transmission of a voice information packet which corresponds to said given silent period; and means at said receiver for detecting the non-transmission of said corresponding voice information packet, and for coupling said comfort noise generator to the output of said receiver in response thereto.

5. The apparatus of claim 1 wherein said second subsystem comprises:

a device for providing periodic estimates of said noise level at said transmitter; and means for transmitting amplitude adjustment parameters respectively representing said noise level estimates across said interface to correspondingly adjust said generator.

6. The apparatus of claim 5, wherein:

each of said transmitted amplitude adjustment parameters is in digital form and comprises a specified number of bits.

7. The apparatus of claim 6, wherein:

said second subsystem further comprises a look-up table coupled to said generator, said look-up table being provided with a specified number of discrete amplitude levels; and each of said amplitude adjustment parameters is disposed to select one of said look-up table amplitude levels and to adjust said generator thereto.

8. The apparatus of claim 7, wherein:

said look-up table stores eight discrete amplitude levels; and said amplitude adjustment parameters respectively comprise three digital bits.

9. The apparatus of claim 1, wherein:

said signal transmission interface comprises an air interface.

10. In a communication system for use in connection with an audio signal comprising interspersed speech present periods and silent periods, wherein said system comprises a transmitter and receiver at opposing sides of a signal transmission interface, and wherein said transmitter is disposed to transmit said audio signal to said receiver during said speech present periods and to discontinue transmission thereof during said silent periods, a method for providing comfort noise comprising the steps of:

operating a comfort noise generator to produce comfort noise of adjustable amplitude at said receiver side of said interface;

notifying said receiver to activate said generator in response to occurrence of one of said silent periods; and transmitting a succession of amplitude parameters through said interface to selectively adjust the amplitude of said comfort noise produced by said comfort noise generator in corresponding relationship with a noise level at said transmitter.

11. The method of claim 10 wherein:

said method further includes the step of producing speech present and speech absent signals at said transmitter side in response to said speech present periods and said silent periods, respectively, of said audio signal.

12. The method of claim 11 wherein:

said speech present and speech absent signals comprise first and second digital bits, respectively, which are transmitted through said interface from said transmitter and received by said receiver, each of said first and second digital bits notifying said receiver of the transmission and non-transmission, respectively, of said audio signal.

13. The method of claim 12 wherein:

said comfort noise generator is coupled to the output of said receiver in response to a second digital bit, and is decoupled from said output in response to a first digital bit.

14. The method of claim 10, wherein voice information is transmitted through said interface in packets of digital bits, and wherein said receiver notifying step comprises:

preventing transmission of a voice information packet which corresponds to a given one of said silent periods; and detecting the non-transmission of said corresponding voice information packet at said receiver, and coupling said comfort noise generator to the output of said receiver in response thereto.

15. The method of claim 10 wherein said step of transmitting amplitude adjustment parameters comprises:

providing periodic estimates of said noise level at said transmitter; and transmitting amplitude adjustment parameters respectively representing said noise level estimates across said interface to correspondingly adjust said generator.

16. The method of claim 15, wherein:

each of said transmitted amplitude adjustment parameters is in digital form and comprises a specified number of bits.

17. The method of claim 16, wherein:

a specified number of discrete amplitude levels are stored in a look-up table coupled to said generator, and each of said amplitude adjustment parameters is disposed to select one of said look-up table amplitude levels and to adjust said generator thereto.

18. The methods of claim 17, wherein:

said look-up table stores eight discrete amplitude levels; and said amplitude adjustment parameters respectively comprise three digital bits.

19. The method of claim 10, wherein:

said signal transmission interface comprises an air interface.

* * * * *

UNITED STATES PATENT AND TRADEMARK OFFICE

CERTIFICATE OF CORRECTION

PATENT NO. : 6,708,147 B2 
DATED : March 16, 2004
INVENTOR(S) : Fisseha Mekuria and Joakim Persson It is certified that error appears in the above-identified patent and that said Letters Patent is hereby corrected as shown below:

Title page,
Item [54], Title, delete "METHOD AND APPARATUS FOR PROVIDING COMFORT NOISE IN COMMUNICATION SYSTEM WITH DISCONTINUOUS TRANSMISSION" insert
-- METHOD OF AND APPARATUS FOR PROVIDING AMPLITUDE-ADJUSTABLE COMFORT NOISE IN COMMUNICATION SYSTEM WITH DISCONTINUOUS TRANSMISSION --

Signed and Sealed this

Ninth Day of August, 2005

JON W. DUDAS
*Director of the United States Patent and Trademark Office*